US005245217A

United States Patent [19]

Honma

[11] Patent Number: 5,245,217

[45] Date of Patent: Sep. 14, 1993

[54] CONTROL DEVICE FOR POWER WINDOW

[75] Inventor: Mikio Honma, Yokohama, Japan

[73] Assignee: Ohi Seisakusho Co., Ltd., Yokohama, Japan

[21] Appl. No.: 735,048

[22] Filed: Jul. 24, 1991

[30] Foreign Application Priority Data

Jul. 30, 1990 [JP] Japan ..... 2-79715[U]

[51] Int. Cl.[5] ..... E05F 15/18

[52] U.S. Cl. ..... 307/10.1; 318/282

[58] Field of Search ..... 307/10.1, 9.1; 180/289; 318/264-267, 281-286; 49/31, 10.1, 24, 31

[56] References Cited

U.S. PATENT DOCUMENTS

| | | | |
|---|---|---|---|
| 4,683,975 | 8/1987 | Booth et al. | 180/289 |
| 4,691,475 | 9/1987 | Maekawa | 49/352 |
| 4,733,145 | 3/1988 | Ohashi et al. | 318/54 |
| 4,850,625 | 7/1989 | Hori et al. | 292/336.3 |

*Primary Examiner*—A. D. Pellinen
*Assistant Examiner*—Aditya Krishnan
*Attorney, Agent, or Firm*—Foley & Lardner

[57] ABSTRACT

A combination in a motor vehicle having a power window is disclosed. The combination comprises an electric power mechanism which can move the window pane downward and upward selectively when energized; a control switch electrically connected to the electric power mechanism for controlling the same, the control switch having a first condition wherein the window pane is moved downward when the control switch assumes a window opening position and a second condition wherein the window pane is moved upward when the control switch assumes a window closing position; an ignition key sensing switch; a locked-/unlocked condition sensing switch; a door opening detecting switch; and a control circuit. The control circuit causes the control switch to assume the first condition when the ignition key sensing switch senses that the ignition key is not in the ignition key cylinder and the locked/unlocked condition sensing switch senses the unlocked condition of the door lock device and causes the control switch to assume the second condition when the ignition key sensing switch senses that the ignition key is not in the the ignition key cylinder and the door opening detecting switch senses that the door is opened.

7 Claims, 1 Drawing Sheet

CONTROL DEVICE FOR POWER WINDOW

BACKGROUND OF THE INVENTION

1. Field of the Invention

The present invention relates in general to power windows of a motor vehicle, and more particularly to control devices for power windows of a type which is particularly applied to a sashless door.

2. Description of the Prior Art

Usually, power windows for motor vehicles are designed to become ready for operation when an ignition key cylinder is turned to ACCESSARY or ON position by an ignition key.

That is, in the power windows of this type, the opening and/or closing operation of the window is permitted only when the ignition key cylinder is at ACCESSARY or ON position with the ignition key put in the ignition key cylinder. Thus, this type power window tends to bring about an inconvenient situation when opening of the window becomes needed by passengers for air ventilation or so with the vehicle being parked. In this case, the ignition key cylinder should be turned to either one of ACCESSARY and ON positions by the ignition key. Furthermore, such type power window becomes inconvenient when a driver leaves the vehicle taking the ignition key with him leaving the window opened. That is, in this case, the window can not be closed by other person.

SUMMARY OF THE INVENTION

It is therefore an object of the present invention to provide a control device for a power window, which is free of the above-mentioned drawbacks.

In accordance with the present invention, there is provided a control device for a power window, which can operate the power window anytime irrespective of the position of the ignition key cylinder, that is, irrespective of whether the ignition key is in the ignition key cylinder or not.

According to the present invention, there is provided, in a motor vehicle having a door with a vertically movable window pane, a combination which comprises an electric power mechanism which can move the window pane downward and upward selectively when energized; a control switch electrically connected to the electric power mechanism for controlling the same, the control switch having a first condition wherein the window pane is moved downward when the control switch assumes a window opening position and a second condition wherein the window pane is moved upward when the control switch assumes a window closing position; an ignition key sensing switch which senses whether an ignition key is in an ignition key cylinder or not; a locked/unlocked condition sensing switch which senses whether a door lock device of the door assumes a locked condition and an unlocked condition; a door opening detecting switch which senses whether the door is opened or not; and a control circuit which causes the control switch to assume the first condition when the ignition key sensing switch senses that the ignition key is not in the ignition key cylinder and the locked/unlocked condition sensing switch senses the unlocked condition of the door lock device and causes the control switch to assume the second condition when the ignition key sensing switch senses that the ignition key is not in the the ignition key cylinder and the door opening detecting switch senses that the door is opened.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the present invention will be described in detail with reference to the accompanying drawings.

Figure 1:
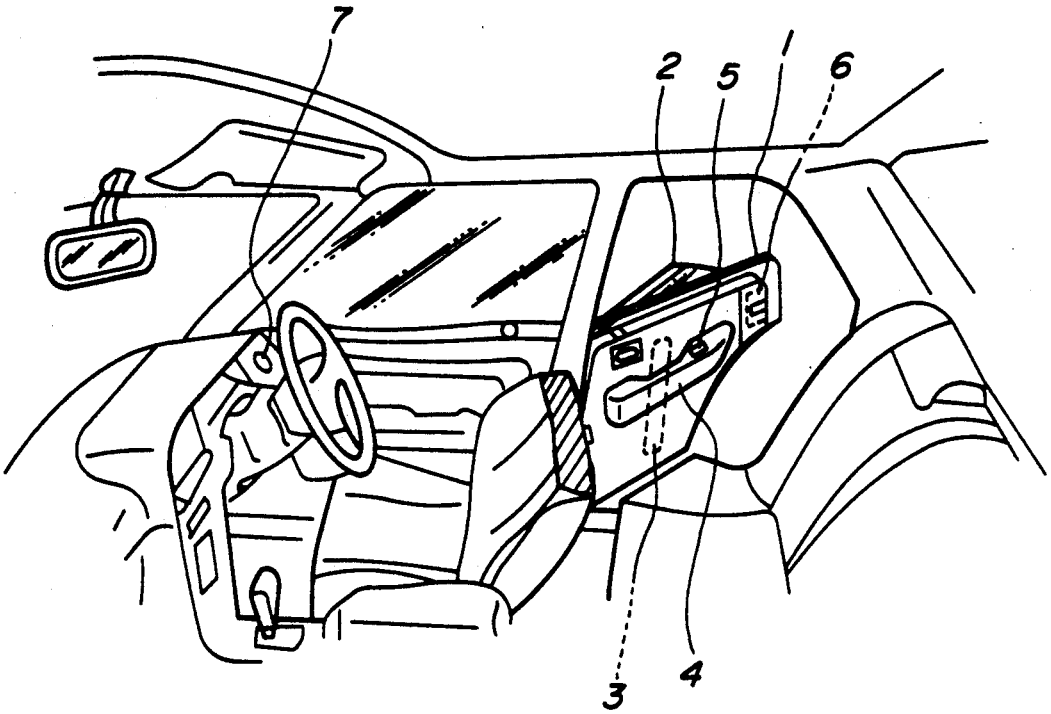
FIG. 1 is a view showing an interior of a motor vehicle to which the present invention is applied.

Referring to FIG. 1, there is shown the interior of a passenger motor vehicle to which the present invention is practically applied.

In the drawing, denoted by numeral 1 is a sashless door hinged at its front end to the vehicle body. The door 1 has a window pane 2 vertically movably mounted thereto.

Within the door 1, there is installed an electric power mechanism 3 for driving the window pane 2, which includes a reversible electric motor (not shown in FIG. 1). One of conventional power mechanisms of this type is disclosed in U.S. Pat. No. 4,691,475 granted on Sep. 8, 1987.

The power mechanism 3 is controlled by a control switch 5 which is mounted on an armrest 4 fixed to the door 1.

Denoted by numeral 6 is a known door lock device which is mounted to a free end of the door 1. One conventional door lock devices of this type is disclosed in U.S. Pat. No. 4,850,625 granted on Jul. 25, 1989. Upon closing of the door 1, a latch plate of the door lock device is brought into engagement with a striker (not shown) secured to the vehicle body thereby to achieve a latched condition of the door 1 relative to the vehicle body.

Denoted by numeral 7 is an ignition key cylinder which is arranged near a steering wheel. As is known, when an ignition key (not shown) put in the ignition key cylinder 7 is turned to "START" position together with the cylinder 7, the engine starts. Upon starting of the engine, the ignition key cylinder 7 is returned to ON position for continued operation of the engine. The ignition key cylinder 7 may have ACCESSARY position wherein various electric accessary parts including the electric power mechanism 3 become ready for operation.

Figure 2:
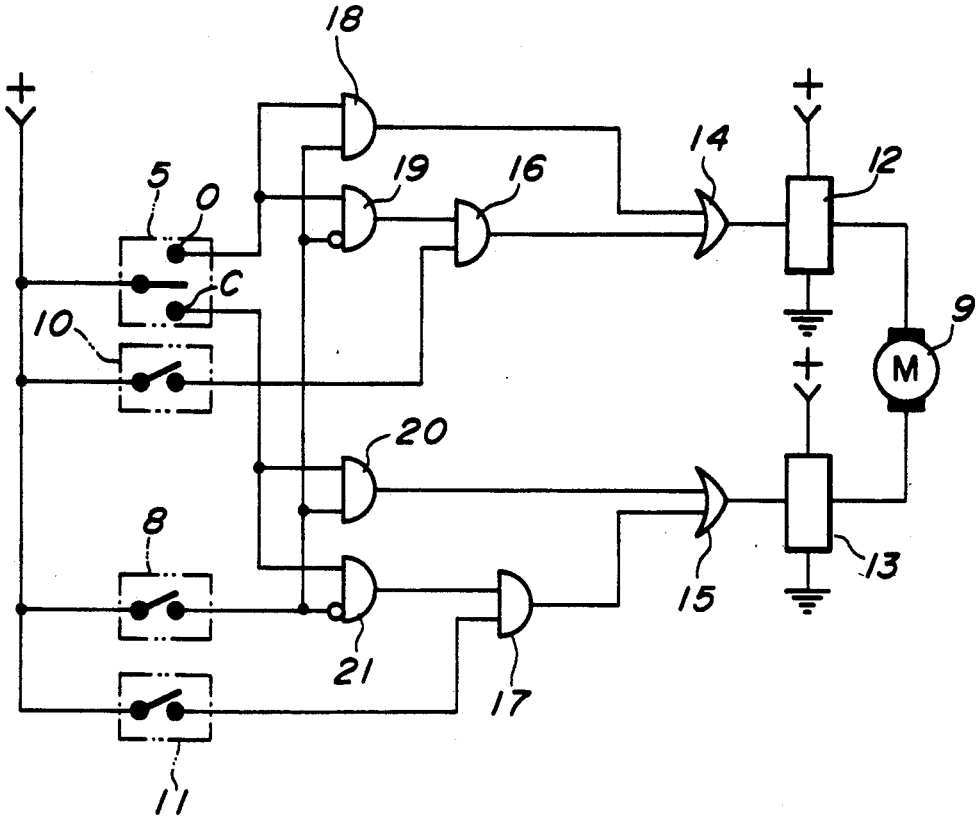
FIG. 2 is an electric circuit employed in the control device of the present invention.

Referring to FIG. 2, there is shown an electric circuit which is employed in the control device of the invention.

The control switch 5 is of a normally open type, which includes two stationary contacts "O" and "C", the contact "O" being for opening the window pane 2 and the other contact "C" being for closing the window pane 2. Usually, the movable contact of the switch 5 assumes a neutral position as shown in the drawing.

Denoted by numeral 8 is a key sensing switch which can sense whether the ignition key is in the ignition key cylinder 7 or not. That is, the key sensing switch 8 is of a normally open type, which is turned ON when the ignition key is put into the ignition key cylinder 7.

Denoted by numeral 9 is the reversible electric motor of the electric power mechanism 3, which produces the power used for moving the window pane 2 upward or downward, that is, in closing or opening direction.

The power mechanism 3 is so arranged that when the motor 9 runs in a normal direction, the window pane 3 is moved downward, that is, in the opening direction, and when the motor 9 runs in a reversed direction, the window pane 3 is moved upward, that is, in the closing direction.

Denoted by numeral 10 is a locked/unlocked condition detecting switch which is mounted in the door lock device 6. That is, the switch 10 is turned OFF when sensing a locked condition of the door lock device 6, but turned ON when sensing an unlocked condition of the same. More specifically, when a locking knob installed inside of the door 1 or a door lock cylinder installed outside of the door 1 is actuated to cause the door lock device 6 to assume the locked condition, the switch 10 is turned OFF.

Denoted by numeral 11 is a door opening detecting switch. The switch 11 is turned OFF when the door 1 is closed with the latch plate of the door lock device 6 operatively engaged with the striker of the vehicle body, and turned ON when the door 1 is opened having the latch plate of the door lock device 6 disengaged from the striker.

Denoted by numeral 12 is a window opening drive circuit which, when completed, supplies electric current of one polarity to the motor 9 to run the same in a normal direction to drive the window pane 2 downward, that is, in the opening direction.

Denoted by numeral 13 is a window closing drive circuit which, when completed, supplies electric current of the other polarity to the motor 9 to run the same in the reversed direction to drive the window pane 2 upward, that is, in the closing direction.

Denoted by numerals 14 and 15 are "OR" circuits, and denoted by numerals 16, 17, 18, 19, 20 and 21 are "AND" circuits.

As shown, the OR circuit 14 has input terminals respectively connected to output terminals of the AND circuits 18 and 16. Thus, the OR circuit 14, when the outputs from the AND circuits 18 and 16 constitute "OR", outputs ON signal to the window opening drive circuit 12 to complete the same. Upon this, the motor 9 is energized to run in the normal direction to move the window pane 2 downward, that is, in the opening direction.

The other OR circuit 15 has input terminals respectively connected to output terminals of the AND circuits 20 and 17. Thus, the OR circuit 15, when the outputs from the AND circuits 20 and 17 constitute "OR", outputs ON signal to the window closing drive circuit 13 to complete the same. Upon this, the motor 9 is energized to run in the reversed direction to move the window pane 2 upward, that is, in the closing direction.

The AND circuit 18 has input terminals respectively connected to the stationary contact "O" of the control switch 5 and the key sensing switch 8. Thus, the AND circuit 18, when the outputs from these switches 5 and 8 constitute "AND", outputs ON signal to the OR circuit 14.

That is, when the ignition is put in the ignition key cylinder 7 causing ON condition of the key sensing switch 8 and the movable contact of the control switch 5 is brought into contact with the stationary contact "O", the AND circuit 18 outputs ON signal to the OR circuit 14. Under this condition, the OR circuit 14 completes the window opening drive circuit 12 and thus the window pane 2 is moved downward, that is, in the opening direction.

The AND circuit 20 has input terminals respectively connected to the other stationary contact "C" of the control switch 5 and the key sensing switch 8. Thus, the AND circuit 20, when the outputs from these switches 5 and 8 constitute "AND", outputs ON signal to the OR circuit 15.

That is, when the ignition key is put in the ignition key cylinder 7 causing ON condition of the key sensing switch 8 and the movable contact of the control switch 5 is brought into contact with the stationary contact "C", the AND circuit 20 outputs ON signal to the OR circuit 15. Under this condition, the OR circuit 16 completes the window closing drive circuit 13 and thus, the window pane 2 is moved upward, that is, in the closing direction.

The AND circuit 19 has input terminals, one being connected to the stationary contact "O" of the control switch 5 and the other being connected through an inverter 19*a* to the key sensing switch 8.

Thus, when the ignition key is not in the ignition key cylinder 7 causing OFF condition of the key sensing switch 8 and the movable contact of the control switch 5 is brought into contact with the stationary contact "C", the AND circuit 19 outputs ON signal to the AND circuit 16.

Thus, when, under this condition, the door lock device 6 assumes the unlocked condition causing ON condition of the locked/unlocked condition detecting switch 10, the AND circuit 16 output ON signal to the OR circuit 14. Thus, under this condition, the door opening drive circuit 12 becomes completed thereby to move the window pane 2 downward, that is, in the opening direction.

The AND circuit 21 has two input terminals, one being connected to the stationary contact "C" of the control switch 5 and the other being connected through an inverter 21*a* to the key sensing switch 8.

Thus, when the ignition key is not in the ignition key cylinder 7 causing OFF condition of the key sensing switch 8 and the movable contact of the control switch 5 is brought into contact with the stationary contact "C", the AND circuit 21 outputs ON signal to the AND circuit 17.

Thus, when, under this condition, the door 1 is opened causing ON condition of the door opening detecting switch 11, the AND circuit 17 outputs ON signal to the OR circuit 15. Under this condition, the window closing drive circuit 13 is completed and thus the window pane 2 is moved upward, that is, in the closing direction.

The AND circuit 16 has input terminals respectively connected to the output terminal of the AND circuit 19 and the locked/unlocked condition detecting switch 10. Thus, the AND circuit 16, when the outputs from the AND circuit 19 and the switch 10 constitute "AND", outputs ON signal to the OR circuit 14.

That is, when, with the ignition key being not in the ignition key cylinder 7 (which causes OFF condition of the key sensing switch 8), the door lock device 6 assumes the unlocked condition causing ON condition of the locked/unlocked condition detecting switch 10 and the movable contact of the control switch 5 is brought into contact with the stationary contact "O", the AND circuit 16 outputs ON signal to the OR circuit 14 causing completion of the window opening drive circuit 12.

If, under this condition, the door lock device 6 changes its condition from the unlocked condition to the locked condition causing OFF condition of the locked/unlocked condition detecting switch 10, the AND circuit 16 stops outputting ON signal to the OR circuit 14. Thus, upon this, the opening movement of the window pane 2 is stopped.

The AND circuits 17 has two input terminals respectively connected to the output terminal of the AND circuit 21 and the door opening detecting switch 11.

Thus, when, with the ignition key being not in the ignition key cylinder 7 (which causes OFF condition of the key sensing switch 8), the door 1 is opened causing ON condition of the switch 11 and the movable contact of the control switch 5 is brought into contact with the stationary contact "C", the AND circuit 17 output ON signal to the OR circuit 15. Upon this, the window pane 2 is moved upward, that is, in the closing direction.

In the following, operation of the control device of the present invention will be described.

For ease of understanding, the description will be commenced with respect to a condition wherein the window pane 2 is in its uppermost or closed position and the ignition key is not put in the ignition key cylinder 7.

When now the ignition key is inserted into the ignition key cylinder 7, the key sensing switch 8 is turned ON. When under this condition, for the purpose of opening the window pane 2, the control switch 5 is so manipulated that the movable contact of the same is brought into contact with the stationary contact "O", the AND circuit 18 outputs ON signal to the OR circuit 14. In accordance with this ON signal, the OR circuit 14 outputs ON signal to the window opening drive circuit 12 to complete the same. Thus, the motor 9 is energized to run in the normal direction and thus, the window pane 2 is moved downward, that is, in opening direction.

When, for the purpose of opening the window pane 2, the control switch 5 is so manipulated that the movable contact of the same is brought into contact with the other stationary contact "C", the AND circuit 20 outputs ON signal to the OR circuit 15. In accordance with this ON signal, the OR circuit 15 outputs ON signal to the window closing drive circuit 13 to complete the same. Thus, the motor 9 is energized to run in the reversed direction and thus, the window pane 2 is moved upward, that is, in closing direction.

It is to be noted that these downward and upward movements of the window pane 2 are carried out irrespective of the conditions of the locked/unlocked condition detecting switch 10 and the door opening detecting switch 11.

When the ignition key is not in the ignition key cylinder 7, the key sensing switch 8 assumes OFF condition.

When, under this condition and with the locked/unlocked condition detecting switch 10 assuming ON condition by sensing the unlocked condition of the door lock device 6, the control switch 5 is so manipulated that the movable contact of the same is brought into contact with the stationary contact "O", the AND circuit 16 outputs ON signal to the OR circuit 14, and thus the window opening drive circuit 12 becomes completed. Thus, under this condition, the motor 9 is energized to run in the normal direction, that is, in the direction to move the window pane 2 downward, that is, in the direction to open the window pane 2.

Thus, the passengers in the vehicle can open the window pane 2 by manipulating the control switch 5, even when the ignition key is not in the ignition key cylinder 7, so long as the door lock device 6 assumes the unlocked condition.

When, with the ignition key being not in the ignition key cylinder 7, closing of the window pane 2 is needed, the following steps are carried out.

That is, upon such requirement, the sashless door 1 is manipulated to open causing ON condition of the door opening detecting switch 11, and then, the control switch 5 is so manipulated that the movable contact of the same is brought into contact with the stationary contact "C". With this, the AND circuit 17 receives ON signals from the AND circuit 20 and the switch 11 and thus outputs ON signal to the OR circuit 15 to complete the window closing drive circuit 13. Thus, under this condition, the motor 9 is energized to run in the reversed direction, that is, in the direction to move the window pane 2 upward.

It is to be noted that this upward movement of the window pane 2 is carried out when the sashless door 1 is opened. Due to the nature of the sashless door, the upward movement does not induce any dangerous matter, unlike a case of a sash type door. That is, in the sash type door, it tends to occur that the operator has his fingers caught between an upper frame of the sash and an upper edge of the window pane 2 during the upward movement of the window pane 2.

Thus, even when a driver leaves the vehicle taking the ignition key with him with the window pane 2 left opened, the window pane 2 can be closed by another person by manipulating the control switch 5.

When the door lock device 6 assumes the locked condition, the AND circuit 16 does not constitute "AND" even when the movable contact of the control switch 5 is brought into contact with the stationary contact "O". Thus, under this condition, the window pane 2 can be opened by a thief who handles the control switch 5 with a pick or the like.

What is claimed is:

1. In a motor vehicle having a passenger's compartment, and a door with a vertically movable window pane, a combination comprising:

an electric power mechanism which can move the window pane downward and upward selectively when energized;

a manually operated control switch mounted in the passenger's compartment of said vehicle, said control switch being electrically connected to said electric power mechanism for controlling the same, said control switch having a first condition wherein said window pane is moved downward when the control switch assumes a window opening position and a second condition wherein said window pane is moved upward when the control switch assumes a window closing position;

an ignition key sensing switch which senses whether an ignition key is in an ignition key cylinder or not;

a door opening detecting switch which senses whether the door is opened or not; and a control circuit which enables said control switch to assume said first condition when said ignition key sensing switch senses that the ignition key is not in said ignition key cylinder and said door opening detecting switch senses a closed condition of said door and enables said control switch to assume said second condition when said ignition key sensing switch senses that the ignition key is not in said ignition key cylinder and said door opening detecting switch senses an opened condition of said door.

2. A combination as claimed in claim 1, in which said control switch comprises a movable contact, a first stationary contact to which said movable contact is brought into contact when opening of the window pane is needed and a second stationary contact to which said movable contact is brought into contact when closing of the window pane is needed.

3. A combination as claimed in claim 2, in which said electric power mechanism comprises:

an electric motor which moves said window pane downward when energized to run in a normal direction and moves said window pane upward when energized to run in the reversed direction;

a window opening drive circuit for energizing said electric motor to run in the normal direction when energized; and a window closing drive circuit for energizing said electric motor to run in the reversed direction.

4. A combination as claimed in claim 3, in which said control circuit comprises;

a first AND circuit having one input terminal connected to said first stationary contact of said control switch and the other input terminal connected to said ignition key sensing switch through an inverter;

a second AND circuit having one input terminal connected to an output terminal of said first AND circuit a first OR circuit operatively interposed between said second AND circuit and said window opening drive circuit;

a third AND circuit having one input terminal connected to said second stationary contact of said control switch and the other input terminal connected to said ignition key sensing switch through an inverter;

a fourth AND circuit having one input terminal connected to an output terminal of said third AND circuit and the other input terminal connected to said door opening detecting switch; and a second OR circuit operatively interposed between said fourth AND circuit and said window closing drive circuit.

5. A combination as claimed in claim 4, in which said control circuit enables said control switch to assume said first and second conditions selectively when said ignition key sensing switch senses that the ignition key is in the ignition key cylinder.

6. A combination as claimed in claim 5, in which said control circuit further comprises:

a fifth AND circuit having one input terminal connected to said first stationary contact of said control switch and the other input terminal connected to said ignition key sensing switch, said fifth AND circuit having an output terminal connected to one input terminal of said first OR circuit; and a sixth AND circuit having one input terminal connected to said second stationary contact of said control switch and the other input terminal connected to said ignition key sensing switch, said sixth AND circuit having an output terminal connected to one input terminal of said second OR circuit.

7. A combination as claimed in claim 6, in which said ignition key sensing switch assumes an ON condition when said ignition key is in the ignition key cylinder, and said door opening detecting switch assumes an ON condition when said door is opened.

* * * * *